US006028006A

United States Patent [19]

Bawa et al.

[11] Patent Number: 6,028,006

[45] Date of Patent: Feb. 22, 2000

[54] METHOD FOR MAINTAINING THE BUFFER CAPACITY OF SILICEOUS CHEMICAL-MECHANICAL SILICON POLISHING SLURRIES

[75] Inventors: Mohendra S. Bawa, Plano; Vikki Sue Simpson, Sherman; Palmer A. Miller, Sherman; Franklin Louis Allen, Sherman; Gary Lee Etheridge, Sherman; Kenneth John L'Anglois, Sherman; Michael H. Grimes, Plano, all of Tex.

[73] Assignee: Texas Instruments Incorporated, Dallas, Tex.

[21] Appl. No.: 08/905,200

[22] Filed: Aug. 1, 1997

[51] Int. Cl.[7] ..... B24B 1/00

[52] U.S. Cl. ..... 438/692; 216/88; 216/89; 438/5; 438/14; 438/693; 451/36; 451/41; 451/287; 451/288

[58] Field of Search ..... 216/88, 89; 438/5, 438/14, 642, 693; 451/36, 41, 287, 288

[56] References Cited

U.S. PATENT DOCUMENTS 5,643,406 7/1997 Shimomura et al. ..... 481/414
5,662,769 9/1997 Schonauer et al. ..... 438/693 X

*Primary Examiner*—Michael Lusignan
*Attorney, Agent, or Firm*—Mark A. Valetti; Christopher L. Maginniss; Richard L. Donaldson

[57] ABSTRACT

A method for maintaining the buffer capacity of a polishing slurry during chemical-mechanical wafer polishing, the method comprising circulating the polishing slurry in a chemical-mechanical wafer polishing apparatus, monitoring the pH of the polishing slurry, combining an agent into the polishing slurry to adjust the pH of the polishing slurry and maintaining the pH of the polishing slurry within a predetermined range, thereby maintaining the buffer capacity of the polishing slurry.

19 Claims, 2 Drawing Sheets

METHOD FOR MAINTAINING THE BUFFER CAPACITY OF SILICEOUS CHEMICAL-MECHANICAL SILICON POLISHING SLURRIES

TECHNICAL FIELD OF THE INVENTION

This invention relates in general to a method to maintain the buffer capacity of siliceous chemical-mechanical silicon polishing slurries, and in particular to, monitoring the pH of a siliceous chemical-mechanical silicon polishing slurry and combining additives with the slurry to maintain the buffer capacity during the silicon polishing process.

BACKGROUND OF THE INVENTION

Without limiting the scope of the invention, its background is described in connection with polishing a semiconductor wafer, as an example.

Heretofore, in this field, chemical-mechanical polishing of silicon wafers has been performed at various stages of device fabrication for planarizing irregular top surface topography. For example, in the process for fabricating modern semiconductor integrated circuits, it is necessary to form conductive lines or other structures above previously formed structures. Prior structure formation, however, often leaves the top surface topography of the silicon wafer highly irregular, with bumps, areas of unequal elevation, troughs, trenches or other surface irregularities. As a result of these irregularities, deposition of subsequent layers of material could easily result in incomplete coverage, breaks in the deposited material, or voids if it were deposited directly over the aforementioned highly irregular surfaces. If the irregularities are not alleviated at each major processing step, the top surface topography of the surface irregularities will tend to become even more irregular, causing further problems as layers stack up in further processing of the semiconductor structure.

Depending upon the type of material used and their intended purposes, numerous undesirable characteristics are produced when these deposition irregularities occur. Incomplete coverage of an insulating oxide layer can lead to short circuits between metalization layers. Voids can trap air or processing gases, either contaminating further processing steps or simply lowering overall device reliability. Sharp points on conductors can result in unusual, undesirable field effects. In general, processing high density circuits over highly irregular structures can lead to very poor yields and device performance.

Consequently, it is desirable to affect some type of planarization or flattening of integrated circuit structures in order to facilitate the processing of multi-layer integrated circuits and to improve their yield, performance, and reliability. In fact, all of today's high-density integrated circuit fabrication techniques make use of some method of forming planarized structures at critical points in the fabrication process.

Conventionally, the polishing apparatus used to planarize a semiconductor wafer has a turntable, often referred to as a rotating platen, and a top ring which exerts a constant pressure on the turntable. A polishing pad is typically attached to the upper surface of the turntable. The semiconductor wafer to be polished, is placed on the polishing pad and clamped between the top ring and the turntable. The semiconductor wafer is securably fixed to the lower surface of the top ring by wax, a pad or a suction so that the semiconductor wafer can be rotated integrally with the top ring during polishing.

While the turntable is rotated, a metered stream of slurry from a slurry supply is delivered to the upper surface of the polishing pad. Typically, the slurry is a liquid comprising chemicals and an abrasive. For example, slurry chemistry generally consists of a basic solution having a pH of about 11. This alkaline polishing slurry may also contain fine polishing particles such as colloidal silica ($SiO_2$.)

With the recent rapid progress in semiconductor device integration and the demands for smaller and smaller wiring patterns for interconnections with narrower spaces between these interconnections, it has been found that improved methods for planarizing irregular surface topology are required. Several parameters have been discovered which affect the quality of chemical-mechanical polishing of silicon wafers. Specifically, mechanical factors such as the pressure exerted by the top ring on the turntable and the platen speed as well as chemical factors such as slurry type, slurry pH, slurry additives, slurry temperature, slurry dilution ratio, and slurry volume each contribute to the quality of the finish on a semiconductor wafer surface after chemical-mechanical polishing.

More specifically, it has been discovered that the quality of the finish is related to the pH of the slurry. Therefore, what is needed is a method to maintain the pH as well as the buffer capacity of a siliceous chemical-mechanical silicon polishing slurry which will allow for recycling and reuse of the silicon polishing slurry resulting in both a cost savings and a reduced environmental impact from discarded volumes of polishing slurry.

SUMMARY OF THE INVENTION

The present invention disclosed herein comprises a method for maintaining the pH and the buffer capacity of a polishing slurry during chemical-mechanical wafer polishing. The method provides for recycling and reusing the polishing slurry so that the polishing slurry is not discarded after each production cycle. The method comprising circulating a polishing slurry in a chemical-mechanical wafer polishing apparatus, monitoring the pH of the polishing slurry, combining an agent into the polishing slurry to adjust the pH of the polishing slurry, and maintaining the pH of the polishing slurry within a predetermined range to maintain the buffer capability of the polishing slurry.

In the chemical-mechanical polishing process of silicon wafers, the polishing slurry commonly contains 20 to 100 nanometer particles of silicon in water stabilized by sodium cations. The hydration of the surface of the silicon particles by water molecules and the surrounding cloud of sodium cations stabilize the slurry against coagulation, settling-out, gelling and precipitation. The range of silica ($SiO_2$) to soda ($Na_2O$) ratio, however, increases with the use of the slurry in a polishing process. The increase in silica to soda ratio destabilizes the slurry and results in aggregation and precipitation of the silica colloidal particles from the polishing slurry. The aggregates and precipitates interfere with the polishing process resulting in polish defects. The aggregates and precipitates also deposit in the flow lines and valves in the polishing slurry pipeline and change the slurry flow conditions.

Also, as the silica to soda ratio increases, the pH of the polishing slurry decreases causing a reduction in the buffer capacity of the polishing slurry. The agents combined into the polishing slurry must therefore increase the pH of the polishing slurry. In the present invention, the agents are selected from the chemical family known as alkalis which are among the strongest bases. Preferably the alkalis used are sodium hydroxide (NaOH) and potassium hydroxide (KOH).

The addition of these alkalis in a suitable amount, maintains the pH of the polishing slurry between about 9.7 and 11.7 and preferably at about 11. The addition of these alkalis result in dissolving silicon oxide agglomerates or precipitates in the polishing slurry. Also, the addition of these alkalis minimizes or eliminates the precipitation of silicon oxides ($SiO_x$) from the polishing slurry.

These and other features of the present invention will be apparent to those skilled in the art from the following detailed description of the invention, taken together with the accompanying drawings.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
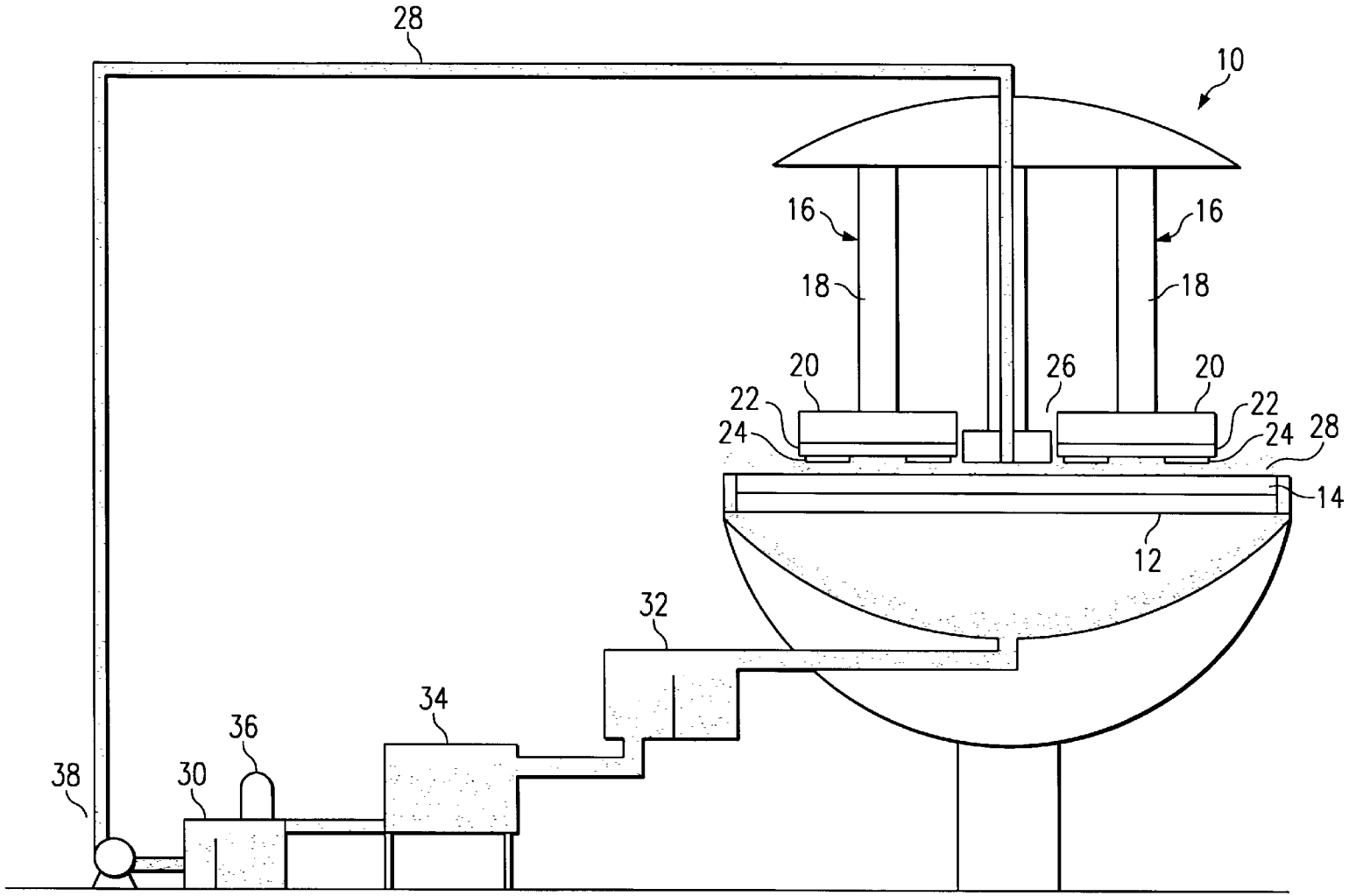
FIG. 1 is a simplified illustration of a wafer polishing apparatus.

In FIG. 1, an apparatus for chemical-mechanical polishing of various workpieces, such as semiconductor wafers, is generally designated 10. The polishing apparatus 10 includes a lower platen 12 having a polishing pad 14 attached thereto on the upper surface of the lower platen 12. The polishing apparatus 10 may include a plurality of polishing units 16. Each polishing unit 16 includes a shaft 18, an upper platen 20 and a carrier plate 22. Each polishing unit 16 holds one or more semiconductor wafer 24.

In operation, the lower platen 12 and the polishing unit 16 are counter rotated such that the lower surface of the semiconductor wafers 24 contacts the upper surface of the pad 14. The polishing units 16 are rotated by center drive 26. While the lower platen 12 and the upper platens 20 are in counter rotation, a slurry 28 is circulated through the polishing apparatus 10. The slurry 28 provides for both chemical and mechanical polishing of the silicon wafers 24.

The slurry 28 may contain particles of silica on the order of 20 to 100 nanometers in diameter. The slurry 28 also comprises water stabilized by sodium cations. The hydration of the surface of the silica particles by water molecules and the surrounding cloud of sodium cations stabilize the slurry 28 against coagulation, settling-out, gelling and precipitation. The range of the silica to soda ratio, however, increases with the use of the slurry 28. The increase in silica to soda ratio destabilizes the slurry 28 and results in aggregation and precipitation of the silica colloidal particles from the slurry 28. The aggregates and precipitates interfere with the polishing process and produce polish defects.

The buffer capacity of the slurry 28 has been empirically derived. The calculations of the buffering capacity show that the buffering power of silicic acid is maximum in the pH range of 9.7 to 11.7 which corresponds to the pKa of the first and second dissociation constants of silicic acid. For example, the use of 7.3 grams of soda, which corresponds to $1.2\times10^{-2}$ moles/liter OH concentration, in a typical 20 liter batch of slurry containing 685 grams of silica assures substantial practical buffering index for the first three runs of a six run slurry batch.

Compared with an ideal value of 0.25, the buffering index after the first run was 0.20, the buffering index after the second run was 0.14, and the buffering index for the third run was 0.10. After the fourth, fifth and sixth runs, the buffering index drops below 0.10 to 0.08, 0.07 and 0.06, respectively. The progressive neutralization of the slurry 28 and corresponding reduction in the buffering index are a result of the self-dissociation of the water, the dissociation of silicic acid, the electrical neutrality of the slurry and the conservation of the added silicon introduced into the slurry 28 as a result of polishing the silicon wafers 24.

The progressive neutralization of slurry 28 is counteracted by combining an agent into the slurry 28 to adjust the pH. Combining the agent with the slurry 28 maintains the pH of the slurry 28 within a predetermined range thereby maintaining the buffer capacity of the slurry 28.

In one embodiment, the agent combined with slurry 28 is an alkalis such as sodium hydroxide (NaOH) or potassium hydroxide (KOH). The addition of one of these alkalis allows the pH of the slurry 28 to be maintained between about 9.7and 11.7. Also the addition of the alkalis dissolves any silicon oxide agglomerates in the slurry 28 and minimizes or eliminates precipitation of silicon oxides in the slurry 28.

The alkalis may be introduced into the slurry 28 in a pH control chamber 30. The necessity for and the amount of agent introduced into the slurry 28 in the pH control chamber 30 may be determined by slurry samples taken at strategic locations throughout the circulation path of the slurry 28. For example, pH may be tested proximate the center drive 26, in the defoaming chamber 32, in the cooling chamber 34, or in the pH control chamber 30. The alkalis may be introduced into the pH control chamber 30 from an agent reservoir 36. After the slurry 28 passes through the pH control chamber 30, a pump 38 circulates the slurry 28 back to the surface of the polishing pad 14.

Figure 2:
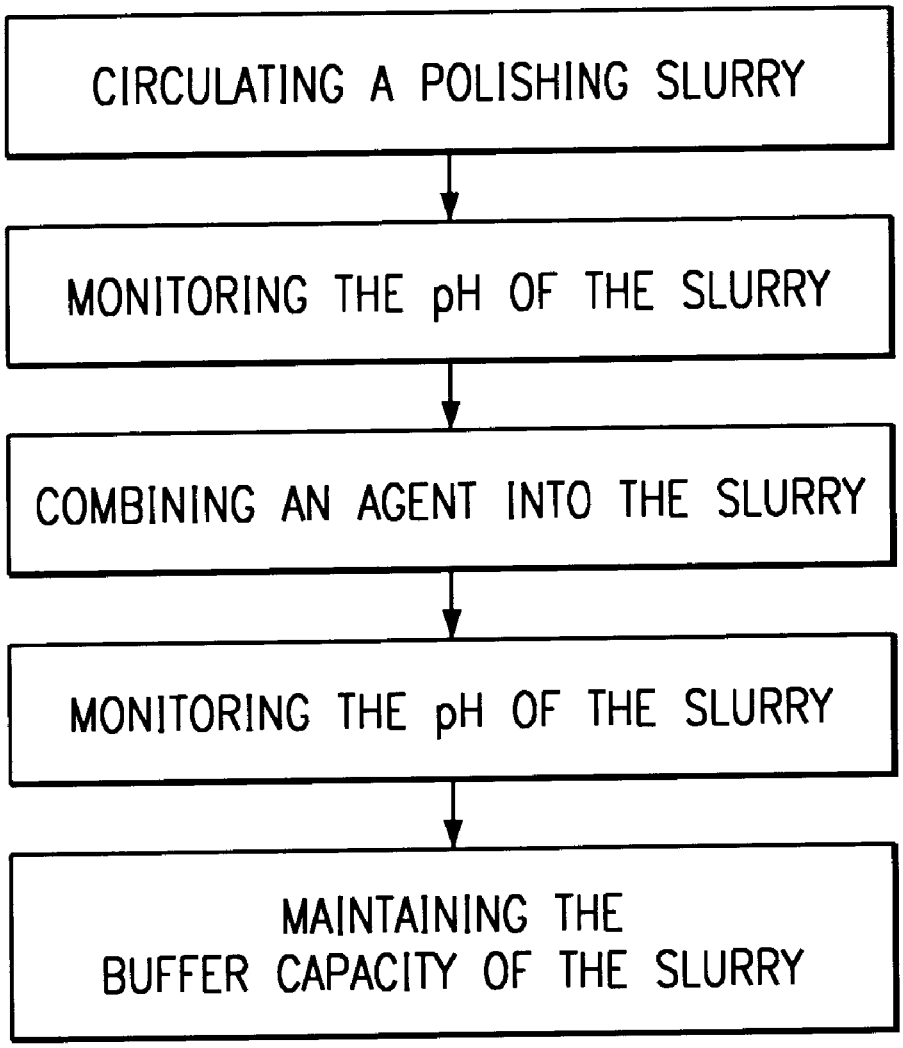
FIG. 2 is a flow diagram showing a method for maintaining the buffer capacity of a chemical-mechanical silicon polishing slurry.

FIG. 2 is a flow diagram showing a method for maintaining the buffer capacity of a polishing slurry during chemical-mechanical wafer polishing, in accordance with the present invention. In this method, a polishing slurry 28 is circulated throughout a polishing apparatus 10. The slurry 28 is circulated as the lower platen 12 and the upper platen 20 rotate relative to one another with the silicon wafers 24 disposed therebetween. The combination of the polishing pad 14 which is disposed above the lower platen 12 and the circulating slurry 28 polishes the back surface of the wafers 24. As the polishing process progresses, the slurry 28 becomes neutralized due to, among other things, the silicon introduced into the slurry 28 as a result of the polishing process. As the slurry 28 is neutralized, the buffer capacity of the slurry is reduced and the quality of the finish on the silicon wafer 28 is diminished.

In order to control the pH of the slurry 28, the rate of neutralization of the slurry 28 and the resulting pH of the slurry 28 must be determined. In the present invention, the pH of the slurry 28 is monitored by sampling the slurry 28 in one or more locations along the slurry circulation path and testing for the pH of the slurry 28 in a conventional manner. For example, a conventional pH meter may be used to continuously monitor the pH.

Once the pH of the slurry 28 is determined, an agent is combined into the slurry 28 in, for example, the pH control chamber 30. Since the agents combined into the slurry 28 must increase the pH of the slurry 28, the agents are alkalis, such as sodium hydroxide (NaOH) and potassium hydroxide (KOH). The quantity of agent required to stabilize the slurry 28 is determined by monitoring the pH of the slurry. Once the appropriate amount of agent is added to the slurry 28, the pH of the slurry 28 is maintained between about 9.7 and 11.7 and preferably about 11. The addition of the agent results in a dissolving of silicon oxide agglomerates or precipitates in the polishing slurry. Also, the addition of these agents minimizes or eliminates the precipitation of additional silicon oxides from the slurry 28. The addition of the agent to the slurry 28 also maintains the buffer capacity of the slurry 28. While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for maintaining the buffer capacity of a polishing slurry during chemical-mechanical wafer polishing, the method comprising:

circulating the polishing slurry in a chemical-mechanical wafer polishing apparatus, the polishing slurry comprises particles of silica in water stabilized by sodium cations;

monitoring the pH of the polishing slurry;

combining an agent into the polishing slurry to adjust the pH of the polishing slurry; and maintaining the pH of the polishing slurry within a predetermined range thereby maintaining the buffer capacity of the polishing slurry.

2. The method as recited in claim 1 wherein the step of combining an agent into the polishing slurry to adjust the pH of the polishing slurry comprises combining an alkalis into the polishing slurry.

3. The method as recited in claim 1 wherein the step of combining an agent into the polishing slurry to adjust the pH of the polishing slurry comprises combining NaOH into the polishing slurry.

4. The method as recited in claim 1 wherein the step of combining an agent into the polishing slurry to adjust the pH of the polishing slurry comprises combining KOH into the polishing slurry.

5. The method as recited in claim 1 wherein the step of maintaining the pH of the polishing slurry within a predetermined range comprises maintaining the pH of the polishing slurry between about 9.7 and 11.7.

6. The method as recited in claim 1 wherein the step of maintaining the pH of the polishing slurry within a predetermined range comprises maintaining the pH of the polishing slurry at about 11.

7. The method as recited in claim 1 further comprising the step of dissolving $SiO_x$, agglomerates in the polishing slurry.

8. The method as recited in claim 1 further comprising the step of minimizing precipitation of $SiO_x$, in the polishing slurry.

9. The method as recited in claim 1 further comprising the step of eliminating precipitation of $SiO_x$ in the polishing slurry.

10. A method for maintaining the buffer capacity in a polishing slurry during chemical-mechanical wafer polishing, the method comprising:

circulating the polishing slurry in a chemical-mechanical wafer polishing apparatus, the polishing slurry comprises particles of silica in water stabilized by sodium cations;

monitoring the pH of the polishing slurry;

combining an alkalis into the polishing slurry to adjust the pH of the polishing slurry; and maintaining the pH of the polishing slurry between about 9.7 and 11.7 thereby maintaining the buffer capacity of the polishing slurry.

11. The method as recited in claim 10 wherein the step of combining an alkalis into the polishing slurry to adjust the pH of the polishing slurry comprises combining NaOH into the polishing slurry.

12. The method as recited in claim 10 wherein the step of combining an alkalis into the polishing slurry to adjust the pH of the polishing slurry comprises combining KOH into the polishing slurry.

13. The method as recited in claim 10 further comprising the step of dissolving $SiO_x$ agglomerates in the polishing slurry.

14. The method as recited in claim 10 further comprising the step of minimizing precipitation of $SiO_x$ in the polishing slurry.

15. The method as recited in claim 10 further comprising the step of eliminating precipitation of $SiO_x$in the polishing slurry.

16. A method for maintaining the buffer capacity in a polishing slurry during chemical-mechanical wafer polishing, the method comprising:

circulating the polishing slurry in a chemical-mechanical wafer polishing apparatus, the polishing slurry comprises particles of silica in water stabilized by sodium cations;

monitoring the pH of the polishing slurry;

combining an alkalis into the polishing slurry to adjust the pH of the polishing slurry;

minimizing precipitation of $SiO_x$ in the polishing slurry;

dissolving $SiO_x$ agglomerates in the polishing slurry; and maintaining the pH of the polishing slurry between about 9.7 and 11.7 thereby maintaining the buffer capacity of the polishing slurry.

17. The method as recited in claim 16 wherein the step of combining an alkalis into the polishing slurry to adjust the pH of the polishing slurry comprises combining NaOH into the polishing slurry.

18. The method as recited in claim 16 wherein the step of combining an alkalis into the polishing slurry to adjust the pH of the polishing slurry comprises combining KOH into the polishing slurry.

19. The method as recited in claim 16 further comprising the step of eliminating precipitation of $SiO_x$ in the polishing slurry.

* * * * *

UNITED STATES PATENT AND TRADEMARK OFFICE

CERTIFICATE OF CORRECTION

PATENT NO. : 6,028,006
DATED : February 22, 2000
INVENTOR(S) : Mohendra S. Bawa, Vikki Sue Simpson, Palmer A. Miller, Franklin L. Allen, Gary L. Etheridge, Kenneth J. L'Anglois and Michael H. Grimes It is certified that error appears in the above-identified patent and that said Letters Patent is hereby corrected as shown below:

Title page,
Column 1, please insert the following: "Related U.S. Application Data" -- [60] Provisional Application No. 60/023,231, 08/05/1996 --

Signed and Sealed this

Sixteenth Day of April, 2002

*Attest:*

*Attesting Officer*

JAMES E. ROGAN
*Director of the United States Patent and Trademark Office*